US006685782B1

(12) United States Patent
Schwellinger

(10) Patent No.: US 6,685,782 B1
(45) Date of Patent: Feb. 3, 2004

(54) COMPONENT

(75) Inventor: Pius Schwellinger, Tengen (DE)

(73) Assignee: Alcan Technology & Management Ltd. (CH)

( * ) Notice: Subject to any disclaimer, the term of this patent is extended or adjusted under 35 U.S.C. 154(b) by 0 days.

(21) Appl. No.: 09/194,294

(22) PCT Filed: May 16, 1997

(86) PCT No.: PCT/CH97/00193

§ 371 (c)(1),
(2), (4) Date: Nov. 23, 1998

(87) PCT Pub. No.: WO97/44501

PCT Pub. Date: Nov. 27, 1997

(30) Foreign Application Priority Data

May 22, 1996 (EP) ..... 96810325

(51) Int. Cl.[7] ..... C22C 21/06; C22C 21/08; C22F 1/05; C22F 1/043

(52) U.S. Cl. ..... 148/440; 148/415; 148/416; 148/417; 148/418

(58) Field of Search ..... 148/415, 416, 148/417, 418, 440, 439; 420/542, 544, 535

(56) References Cited

U.S. PATENT DOCUMENTS

| | | | | |
|---|---|---|---|---|
| 4,525,326 A | | 6/1985 | Schwellinger et al. | 420/535 |
| 5,527,404 A | | 6/1996 | Warren | 148/688 |
| 5,571,347 A | * | 11/1996 | Bergsma | 148/550 |
| 5,766,546 A | * | 6/1998 | Schwellinger | 420/544 |

FOREIGN PATENT DOCUMENTS

| | | | |
|---|---|---|---|
| BE | 906107 | * | 4/1987 |
| DE | 32 43 371 | | 3/1984 |
| DE | 44 21 744 | | 1/1995 |
| JP | 54004806 | * | 1/1979 |
| JP | 61163232 | * | 7/1986 |
| JP | 04147935 | * | 5/1992 |
| JP | 04341546 | * | 11/1992 |
| JP | 5247610 | | 9/1993 |
| JP | 06240424 | * | 8/1994 |
| JP | 06272000 | * | 9/1994 |
| JP | 07003371 | * | 1/1995 |
| JP | 08049052 | * | 2/1996 |
| WO | WO96/12829 | | 5/1996 |

OTHER PUBLICATIONS

W. Hufnagel "Aluminium Taschenbuch" 1983 p. 141=–143.

* cited by examiner

*Primary Examiner*—Sikyin Ip
(74) *Attorney, Agent, or Firm*—Ostrolenk, Faber, Gerb & Soffen, LLP

(57) ABSTRACT

A suitable alloy of the alloy AlMgSi type employed for the manufacture of components having high capacity to absorb kinetic energy by plastic deformation contains, in wt. %,

| | | |
|---|---|---|
| silicon | | 0.40 to 0.80 |
| magnesium | | 0.40 to 0.70 |
| iron | max. | 0.30 |
| copper | max. | 0.20 |
| manganese | max. | 0.15 |
| vanadium | | 0.05 to 0.20 |
| chromium | max. | 0.10 |
| titanium | max. | 0.10 |
| zinc | max. | 0.10 |

and further elements each individually at most 0.05, in total at most 0.15 and the remainder aluminium.

18 Claims, No Drawings

COMPONENT

PRIORITY CLAIM

This is a U.S. national stage of application No. PCT/CH97/00193, filed on May 16, 1997. Priority is claimed on that application and on the following application:

Country: Europe, Application No.:96810325.9, Filed: May 22, 1996.

BACKGROUND OF THE INVENTION FIELD OF THE INVENTION

The invention relates to a component made of an alloy of the AlMgSi type having a high capacity to absorb kinetic energy by plastic deformation.

DISCUSSION OF THE PRIOR ART

Crash behaviour is becoming an increasingly important aspect of vehicle manufacture. This holds both for road transport and for rail transport.

The manufacturers of road and railway vehicles are increasingly dimensioning special components or complete units of the vehicle in such a way that, on collision, they are able to absorb as much energy as possible in order to reduce the risk of injury to the passengers.

Apart from the constructive aspects of these so called crash elements, the mechanical properties of the alloys employed and the joints are of decisive importance in this respect. Desired is the maximum possible absorption of energy before fracture. This can be achieved by a low ratio of yield strength to strength at rupture. An important material characteristic is also a high degree of elongation. The mechanical properties of joining areas such as weld seams should differ as little as possible from those of the parent metal. In the case of extrusions good elongation in the transverse direction is also of great importance.

Attention must also be given to the requirements made of the finished construction. For example specified values may be given for the construction with respect to strength, minimum elongation, corrosion resistance or other essential characteristics.

Among the aluminium alloys which are fabricated into crash elements today are in particular the standard alloys of the AlMgSi type. Alloys of this type, compared with others such as e.g. AlZnMg alloys, provide good preconditions in the form of elongation and formability for energy-absorbing parts. In spite of that, further optimisation of properties is desirable.

The alloy AA6005A employed at present for the construction of carriages gives rise to a series of problems in manufacture which are associated with the tendency for coarse grain recrystallisation. With a coarse grain microstructure it is difficult to achieve the given bending radii- the tendency for grain boundary opening being reinforced by welding. This leads to a large number of nonconformities in production. If this is to be avoided, then the parts must be manufactured such that the cross-section of the extrusion is mainly fibrous in grain structure. At present this is possible only using an alloy composition which leads to higher extrusion forces and significantly lower extrusion rates. This means that large penalties in productivity have to be accepted as a consequence.

Components employed as safety parts in automobile manufacture often do not have to reach the high strength values prescribed in railway carriage manufacture. On the other hand the extruded components employed in automobile manufacture often exhibit section wall thicknesses of the order of 1 mm or even less. Such low wall thicknesses cannot be extruded using alloys with too high strength, or at least not economically.

SUMMARY AND DESCRIPTION OF THE INVENTION

The object of the invention is to provide a material having especially good formability along with good mechanical properties in the component. The material should exhibit a strength level comparable to or slightly lower than that of the alloy AA6005A, but afford a higher degree of success in production and higher productivity.

The objective of the invention is achieved by way of the alloy containing in wt. %

| | | |
|---|---|---|
| silicon | | 0.40 to 0.80 |
| magnesium | | 0.40 to 0.70 |
| iron | max. | 0.30 |
| copper | max. | 0.20 |
| manganese | max. | 0.15 |
| vanadium | | 0.05 to 0.20 |
| chromium | max. | 0.10 |
| titanium | max. | 0.10 |
| zinc | max. | 0.10 |

and further elements each individually at most 0.05, in total at most 0.15 and the remainder aluminium.

The alloy according to the invention is with respect to strength and elongation much less quench sensitive than the alloy AA6005A and even at wall thicknesses of 6 mm exhibits fine grain structure throughout the whole of the cross-section. The alloy is therefore basically suitable for use in large extruded sections.

Silicon and magnesium are preferably restricted when the material is used in components with high strength requirements such as in railway carriages, these limitations in wt. % are as follows:

| | |
|---|---|
| silicon | 0.45 to 0.75, in particular 0.55 to 0.65 |
| magnesium | 0.45 to 0.65, in particular 0.50 to 0.60 |

For components having lower strength requirements, such as extruded sections for automobile manufacture, and having partially low wall thickness of 1 mm or less, the following ranges in wt. % apply to silicon and magnesium:

| | |
|---|---|
| silicon | 0.45 to 0.60, in particular 0.45 to 0.55 |
| magnesium | 0.40 to 0.60, in particular 0.45 to 0.50 |

The following preferred range of values holds for the other elements, other than silicon and magnesium, in the alloy according to the invention:

| | |
|---|---|
| iron | 0.18 to 0.25 |
| copper | 0.08 to 0.16 |
| manganese | 0.05 to 0.10 |

-continued

| | |
|---|---|
| vanadium | 0.06 to 0.15 |
| chromium | max. 0.08, preferably max. 0.01 |
| titanium | max. 0.05 |

The use of the alloy composition according to the invention for the manufacture of components with a high capacity to absorb energy leads to a favourable microstructure in the component. The—smallest possible—grain size, obtained in order to improve the forming properties, is achieved by the alloy composition according to the invention.

A component with particularly good properties with respect to energy absorption along with good strength values, can be obtained using a special heat treatment. This comprises creating an underaged or partially hardened condition in the alloy i.e. the alloy is not hardened to give maximum strength. The underaged condition is obtained by heat treating (artificial age-hardening) in the range 120 to 170° C. for an interval of 4 to 6 h. The desired degree of under-age-hardening may be determined by means of simple trials; the condition T64 is preferred.

A further preferred heat treatment, which in particular in the automobile industry can be combined with paint stoving, comprises heating between 190 and 230° C. for an interval of 1 to 5 h. Such a treatment produces a slight overaging, the condition T72 being preferred.

The components according to the invention are, in the simplest case, extruded sections. Feasible, however, are also components which start from an extruded section as a preform and achieve their final shape as a result of pressure from within. According to a further version of the invention, the component may also be a forging.

A preferred use of the component according to the invention is for safety parts in automobile manufacture.

The advantages of the alloys according to the invention in their use for manufacturing crash elements and the special heat treatments for underaging or overaging are underlined by the following test results.

EXAMPLES

Extrusion trials with the all according to the invention at a high strength level (alloy C, see below) showed that the rate of extrusion can be increased significantly over that using AA6005A. In a production trial in which a section for the base of a railway carriage was produced—difficult from the standpoint of extrusion—the rate of extrusion could be increased e.g. by 70% without the alloy exhibiting any edge cracks; the upper limit was in fact given by the maximum force available from the extrusion press. An average increase of 50% may be realistically assumed as a result of employing the alloy according to the invention instead of alloy AA6005A.

The mechanical properties of the alloys according to the invention were obtained in tensile tests and from fatigue tests for the heat treatment conditions T6 (fully age hardened) and T64 (partially age hardened).

Heat Treatment Condition T6

This condition is reached by means of heat treatment at 160° C. for 10 h. The duration of heat treatment is less than that required for full hardness which would be obtained with aprox. 20 h at 160° C.

The characteristic values obtained by tensile testing can vary depending on the actual composition, degree of deformation, thickness of section and cooling conditions. The experience obtained to date indicates the following minimum values:

| | Section thickness | | | | | |
|---|---|---|---|---|---|---|
| | 2–4 mm | | | 4–8 mm | | |
| | 0.2% PS [MPa] | UTS [MPa] | A5 [%] | 0.2% PS [MPa] | UTS [MPa] | A5 [%] |
| Parent metal | 230 | 275 | 10 | 230 | 270 | 8 |
| Butt weld (MIG) | 120 | 180 | — | 115 | 165 | — |

The typical 0.2% proof stress values (PS) lie around 240 MPa, the ultimate tensile strength (UTS) of the parent metal in the longitudinal direction around 290 MPa and the elongation A5 around 12%. In the transverse direction the proof stress and the ultimate tensile strength are about the same level. A5 falls to about 6%. In all the transverse samples tested extrusion welds were present in all of the test pieces. In no case was fracture observed in the immediate area of the weld seam—which is a result of the high degree of formability due to the fine grain size in the region of the weld seam the hardness is in the range of 94 to 105 HB.

The characteristic values of the weld are valid for MIG-machine welded joints. In the given thickness range the characteristic values differ depending whether SG—AlMg4.5Mn, SG—AlMgS, or SG—AlSi5 filler is metal used. Errors such as edge displacement due to problems that arise when welding large sections have a more pronounced effect on the results. Typical values for dressed welds are 130 MPa for the 0.2% PS, 210 MPa for the UTS and 4% for A100. These values are reached after about 30 days after welding: The cold (natural) age hardening in the heat affected zone is still not complete after that interval. Testing after 90 days shows a further increase of about 10 MPa in the 0.2% PS, whereas the UTS increases only slightly and the elongation remains constant within the accuracy of measurement.

The following values were obtained in the fatigue tests:

| | N* = | |
|---|---|---|
| | $10^4$ Δσ [MPa] | $>10^7$ Δσ [MPa] |
| Parent metal (longitudinal) | | 110 |
| Butt weld (MIG) | 90 | 45 with excess weld material |
| | 95 | 55 excess weld material removed |

*N = number of load cycles

The value for the parent metal was obtained with 3 mm thick lengths. Under comparable conditions values of >100 MPa were obtained as a rule when using AA6005A. The values for the weld joint were obtained using 4 mm thick material.

Heat Treatment Condition T64

This condition was reached after heat treating at 140° C. for 8 h. The definition of the crash tolerance was determined as follows from the characteristic values obtained in tensile testing in the partially age hardened condition:

| | Section thickness 2–4 mm | | |
|---|---|---|---|
| | 0.2% PS [MPa] | UTS [MPa] | A5 [%] |
| Parent metal | 140–180 | >220 | >18 |
| Butt weld (MIG) | >120 | >180 | >5 (A100) |

The typical tensile strength values of the parent metal in the longitudinal direction lie around 255 MPa, elongation A5 at 25%. In the transverse direction the strength falls slightly to 250 MPa, the elongation A5 to 12%. All of the tested transverse test pieces contained extrusion welds. In no case was fracture observed in the immediate vicinity of the extrusion weld. The hardness lies in the range of 74 to 85 HB.

Typical values for dressed welds (weld bead crown and root machined flat) were 130 MPa for the 0.2% PS, 210 MPa for the UTS and 10% for the elongation A100. Such a high elongation is exceptional. This has a favourable effect in the case of a crash. Also here even higher 0.2% PS values are obtained after natural age hardening for 90 days.

To document the mechanical properties in the weld region, 2 mm thick tensile test pieces were machined out of 6 mm thick welded sections parallel to the weld bead at specific distances (positions) from the centre of the weld bead and tested (4 tensile test pieces per position). The results are summarised in the following tables.

Tensile testing parallel to the weld bead in the heat affected zone. SG-AlMg5 filler metal

| Position | mm | 0.2% PS MPa | UTS MPa | Ag % | A5 % |
|---|---|---|---|---|---|
| 1 | 0 | 108 | 214 | 17.2 | 20.9 |
| 2 | 9 | 117 | 221 | 21.3 | 27.7 |
| 3 | 15 | 118 | 181 | 15.5 | 22.7 |
| 4 | 27 | 136 | 210 | 16.4 | 21.3 |
| 5 | 84 | 159 | 245 | 17.4 | 19.5 |

Tensile testing parallel to the weld bead in the heat affected zone. SG-AlSi5 filler metal

| Position | mm | 0.2% PS MPa | UTS MPa | Ag % | A5 % |
|---|---|---|---|---|---|
| 1 | 0 | 106 | 205 | 14.7 | 16.2 |
| 2 | 9 | 111 | 195 | 20.7 | 25.7 |
| 3 | 15 | 140 | 207 | 17.0 | 22.1 |
| 4 | 27 | 154 | 238 | 19.6 | 21.9 |
| 5 | 84 | 159 | 240 | 17.3 | 18.6 |

The positions are the distances from the centre of the weld bead. Position 1 lies completely in the weld bead, position 5 in the unaffected parent metal.

The results show that the strength within the weld bead (weld bead and heat affected zone) drops relatively little from that of the parent metal and high ductility is obtained throughout the whole region.

The following values were obtained in the fatigue tests:

| | Fatigue N* = | |
|---|---|---|
| | $10^4$ Δσ [MPa] | $>10^7$ Δσ [MPa] |
| Parent metal (longitudinal) | | 95 |
| Butt weld (MIG) | 85 | 45 with excess weld material |
| | 95 | 50 excess weld material removed |

*N = number of load cycles

The fatigue tests were carried out on sections from the same production run as that tested in the T6 condition.

The scatter in mechanical properties obtained at the start and end of the extruded section is smaller in the case of the alloy according to the invention than with the alloy AA6005A. This is due to the more uniform grain structure and the lower degree of quench sensitivity. The following results show by way of example production values obtained along the length of a section:

| Tensile test n = 6 | 0.2% PS | UTS | Ag | A5 |
|---|---|---|---|---|
| Parent metal 160° C. 10 h, longitudinal direction | | | | |
| Average value | 241 | 291 | 10.8 | 12.9 |
| Standard deviation | 1.4 | 2.1 | 0.3 | 0.5 |
| Minimum | 239 | 288 | 10.4 | 12.3 |
| Parent metal 140° C. 8 h, longitudinal direction | | | | |
| Average value | 165 | 255 | 18.6 | 23.3 |
| Standard deviation | 0.5 | 0.3 | 0.4 | 0.4 |
| Minimum | 164 | 255 | 17.9 | 22.9 |

Crash Behaviour

The behaviour in crash conditions depends essentially on the material properties, the design and dimensions of the crash element. A first prerequisite for the suitability of a material in a given design and dimension is the ability to fold without fracturing prematurely. Crash behaviour is tested by compressing pipe-shaped sections or hollow sections which are square in cross-section. Alloys A, B and C were tested in a first test series; and in a second test series the alloys B, D and E; the compositions of the materials tested are as follows:

| | Si | Fe | Cu | Mn | Mg | Cr | Zn | V | Ti |
|---|---|---|---|---|---|---|---|---|---|
| A | 0.45 | 0.21 | 0.02 | 0.02 | 0.43 | — | 0.03 | — | 0.02 |
| B | 0.54 | 0.21 | — | 0.08 | 0.59 | — | — | — | 0.10 |
| C | 0.62 | 0.26 | 0.16 | 0.07 | 0.56 | — | — | 0.10 | 0.10 |
| D | 0.52 | 0.21 | — | 0.08 | 0.57 | — | — | 0.09 | 0.10 |
| E | 0.51 | 0.21 | 0.11 | 0.06 | 0.49 | — | — | 0.10 | 0.10 |

In the compression tests on the first test series the alloy according to the invention viz., alloy C always achieved the highest values of absorbed energy in relation to the mass of the crash element. With this alloy, using thin tube as test material, folding without fracture and a higher degree of energy absorption was also recorded in the T64 and T6 conditions than in the T4 condition.

In the second test series of compression tests using rectangular hollow sections with a cross-section of 56×65 mm, a length of 300 mm and thickness of 1 mm the alloys according to the invention viz., alloys D and E always achieved the highest degree of energy absorption with respect to the mass of the crash element. In the examples given here the condition T72 was obtained by artificial age hardening for 5 h at 205° C. and condition T6 by treating at 160° C. for 10 h.

The results of the compression tests in both test series are summarised in the following tables.

Crash Test Results from Tube-shaped Test Pieces

| Alloy | Condition | Diameter [mm] | Thickness [mm] | Type of fold | Absorbed energy/ mass [kJ/kg] |
|---|---|---|---|---|---|
| A | T4 | 92 | 1.5 | as | 14.4 |
| B | T4 | 92 | 1.5 | as | 17.8 |
| C | T4 | 92 | 1.5 | as | 22.1 |
| C | T64 | 92 | 1.5 | as | 25 |
| C | T6 | 92 | 1.5 | as | 25.7 |
| A | T4 | 70 | 5 | rs | 52 |
| B | T4 | 70 | 5 | rs | 47 |
| C | T4 | 70 | 5 | rs | 58 |

*) as = asymmetric with nodal points
rs = ring symmetrical

Crash Test on Rectangular Hollow Sections

| Alloy | Type of cooling following extrusion | Absorbed energy/mass [kJ/kg] T72 | T6 |
|---|---|---|---|
| B | forced air | 14.6 | 17.6 |
| D | forced air | 19.0 | 18.8 |
| E | forced air | 20.9 | 20.0 |
| B | water spray | 19.1 | 16.8 |
| D | water spray | 19.8 | 18.2 |
| E | water spray | 21.6 | 18.2 |

Structure

On extrusion the alloy recrystallised with a fine grain structure—at the same time retaining some fraction of the deformation structure in the grains. This is the most important basis for the properties being in various ways superior to those of the alloy AA6005A. Fine-grained recrystallisation requires an adequate degree of deformation with respect to time.

Welding Behaviour

The alloy according to the invention lends itself well to welding. No significant degree of parting at grain boundaries was ever observed in butt welded joints made with section lengths from large sections using SG—AlMg4.5Mn filler metal.

Corrosion

Comparison corrosion trials were carried out using the alloys B T6, AA6005A and the alloy according to the invention C T6 and CT64. An RID test was carried out on the parent metal, the salt spray test on welded lengths of section. A definite difference in behaviour was observed in the RID test (24 h in a solution of 3% NaCl+0.5% HCl at room temperature). In that test the alloy AA6005A was attacked to a depth of about 250 $\mu$m. The other alloys and conditions showed only occasional signs of intercrystalline corrosion. In the salt spray test according to DIN 50021 SS (5% NaCl solution at 35±2° C.) after 1000 h there was no difference in behaviour between the alloys and conditions. Particular susceptibility to corrosive attack could not be identified for any of the alloys in the tests carried out.

Conclusions

The alloy according to the invention is well suited for use in vehicle manufacture. The characteristic tensile values required for the parent metal and for welded joints are reached without problem. The alloy may be used equally for small and for large sections. It is equally suitable for crash elements and for components which are made by forming under the application of pressure on the inside.

The reliability of production is much better than with the alloy AA6005A because of the lower quench sensitivity and the fine-grained recrystallisation of the alloy according to the invention.

The rate of extrusion can in general be increased by more than 50% over that of the alloy AA6005A.

Extrusion welds do not have a negative effect on the mechanical properties.

On welding with SG—AlMg filler metals, in the thickness range in which the alloy recrystallises in a fine grained manner, no grain boundary opening is observed of a magnitude which could have a significant influence on the mechanical properties of the welded joint, provided the shrinkage due to solidification is not greatly hindered. This results in good ductility. In particular the partially age hardened version T64 exhibits a low drop in characteristic values for the welded joint compared with those of the parent metal.

In all, the alloy according to the invention is found to be an alloy with a good combination of properties viz., strength, elongation, weldability and reliability of production. This applies both to the partially age hardened condition and to the fully hardened condition.

What is claimed is:

1. A component made of an AlMgSi alloy having high capacity to absorb kinetic energy by plastic deformation, the alloy containing in wt. %:

| | | |
|---|---|---|
| silicon | | 0.40 to 0.80; |
| magnesium | | 0.40 to 0.70; |
| iron | max. | 0.30; |
| copper | max. | 0.20; |
| manganese | max. | 0.15; |
| vanadium | | 0.05 to 0.20; |
| chromium | max. | 0.10; |
| titanium | max. | 0.10; |
| zinc | max. | 0.10; |

further elements each individual at most 0.05, in total at most 0.15; and a remainder aluminium, wherein the alloy is one of in a partially age hardened condition T64 and in an over-aged condition T72.

2. A component according to claim 1, wherein the alloy contains, in wt. %,

| | |
|---|---|
| silicon | 0.45 to 0.75, |
| and | |
| magnesium | 0.45 to 0.65. |

3. A component according to claim 2, wherein the alloy contains, in wt. %

| | |
|---|---|
| silicon | 0.55 to 0.65, |
| and | |
| magnesium | 0.50 to 0.60. |

4. A component according to claim 1, wherein the alloy contains, in wt. %,

| | |
|---|---|
| silicon | 0.40 to 0.60, |
| and | |
| magnesium | 0.40 to 0.60. |

5. A component according to claim 4, wherein the alloy contains, in wt. %,

| | |
|---|---|
| silicon | 0.45 to 0.55, |
| and | |
| magnesium | 0.45 to 0.55. |

6. A component according to claim 1, wherein the alloy contains 0.18 to 0.25 wt. % iron.

7. A component according to claim 1, wherein the alloy contains 0.12 to 0.16 wt. % copper.

8. A component according to claim 1, wherein the alloy contains 0.05 to 0.10 wt. % manganese.

9. A component according to claim 1, wherein the alloy contains 0.06 to 0.15 wt. % vanadium.

10. A component according to claim 1, wherein the alloy contains at most 0.08 wt. % chromium.

11. A component according to claim 10, wherein the alloy contains at most 0.01 wt. % chromium.

12. A component according to claim 1, wherein the alloy contains at most 0.05 wt. % titanium.

13. A component according to claim 1, wherein the alloy is in a partially age hardened condition T64 after a heat treatment of 4 to 16 h at 120 to 170° C.

14. A component according to claim 1, wherein the alloy is in a overaged a condition T72 after a heat treatment of 1 to 5 h at 190 to 230° C.

15. A component according to claim 1, wherein the component is an extruded section.

16. A component according to claim 1, wherein the component is an extruded section subjected to internal pressure.

17. A component according to claim 1, wherein the component is a forging.

18. A safety part for a vehicle made of an AlMgSi alloy having high capacity to absorb kinetic energy by plastic deformation, the alloy containing in wt. %:

| | | |
|---|---|---|
| silicon | | 0.40 to 0.80; |
| magnesium | | 0.40 to 0.70; |
| iron | max. | 0.30; |
| copper | max. | 0.20; |
| manganese | max. | 0.15; |
| vanadium | | 0.05 to 0.20; |
| chromium | max. | 0.10; |
| titanium | max. | 0.10; |
| zinc | max. | 0.10; |

further elements each individually at most 0.05, in total at most 0.15; and a remainder aluminum, wherein the alloy is one of in a partially age hardened condition T64 and in an overaged condition T72.

* * * * *